US008858120B2

(12) United States Patent
Allen et al.

(10) Patent No.: US 8,858,120 B2
(45) Date of Patent: Oct. 14, 2014

(54) LIQUID CONTAINMENT SYSTEM

(75) Inventors: Bruce Allen, Selkirk (CA); John Mascarenhas, Winnipeg (CA); Michael Fell, Winnipeg (CA)

(73) Assignee: Vicwest Inc., Oakville ON (CA)

( * ) Notice: Subject to any disclaimer, the term of this patent is extended or adjusted under 35 U.S.C. 154(b) by 0 days.

(21) Appl. No.: 13/182,618

(22) Filed: Jul. 14, 2011

(65) Prior Publication Data

US 2013/0017018 A1 Jan. 17, 2013

(51) Int. Cl.
*E02B 7/08* (2006.01)
*E02D 27/01* (2006.01)

(52) U.S. Cl.
CPC ..... *E02D 27/01* (2013.01)
USPC ..... 405/114; 405/107; 405/110

(58) Field of Classification Search
CPC ..... E04H 4/00; E04H 3/00
USPC ..... 405/107, 110, 112, 114, 115; 220/4.03, 220/4.16, 4.21, 4.34, 1.5, 1.6, 9.4; 256/28–31; 217/3 BC, 3 R; 52/169.7, 52/102; 4/506
See application file for complete search history.

(56) References Cited

U.S. PATENT DOCUMENTS 215,570 A * 5/1879 Camp ..... 256/31
236,662 A * 1/1881 Austin et al. ..... 256/31
394,361 A * 12/1888 Hobson ..... 256/31
2,018,920 A * 10/1935 Mette ..... 405/284
3,225,362 A * 12/1965 Barrera ..... 52/169.1
3,233,251 A * 2/1966 Barrera ..... 52/245
3,409,916 A * 11/1968 Billig et al. ..... 52/146
3,444,659 A * 5/1969 Shanni ..... 52/149
3,466,676 A * 9/1969 Barrera ..... 52/169.7
3,486,289 A * 12/1969 Lavack ..... 52/741.12
3,562,822 A * 2/1971 Wall ..... 52/245
3,648,303 A * 3/1972 Stewart et al. ..... 52/5
3,819,079 A * 6/1974 Levens ..... 220/4.13
3,937,355 A * 2/1976 Engebretsen ..... 220/4.21
3,986,310 A * 10/1976 van den Broek ..... 52/169.9
3,991,530 A * 11/1976 Scourtes ..... 52/146
4,169,331 A * 10/1979 Baker ..... 43/11
4,782,538 A * 11/1988 Chisholm et al. ..... 4/506
5,116,300 A * 5/1992 Pildysh ..... 405/107
5,161,264 A * 11/1992 Dugas ..... 4/506
5,439,316 A * 8/1995 Richardson ..... 405/114
5,470,177 A * 11/1995 Hughes ..... 405/115
5,622,021 A * 4/1997 Bookout ..... 52/582.1
5,882,142 A * 3/1999 Siglin et al. ..... 405/52
5,950,680 A * 9/1999 Randall ..... 138/96 R (Continued)

*Primary Examiner* — Thomas B Will
*Assistant Examiner* — Jessica H Lutz
(74) *Attorney, Agent, or Firm* — Adrian D. Battison; Ade & Company Inc.

(57) ABSTRACT

A liquid containment barrier is formed by corrugated panels connected end to end and supported by upstanding brackets at spaced positions around the peripheral wall and a liner attached to the wall. Each panel has the top edge as a raw edge with a plurality of elongate extruded plastics spring channel members engaged over the top edge. A plurality of additional clamp collars are arranged to surround a part cylindrical portion of the channel members to bridge between panels and to form a local clamping force on the channel member. Each bracket has an inner vertical edge engaging the panels and a rod member hooked to the brace at the lower end and engaging over the channel members at the upper end. The bracket also includes an upwardly extending flange parallel to the inner edge to form a channel for the bottom edge of the panel.

17 Claims, 10 Drawing Sheets

(56) References Cited

U.S. PATENT DOCUMENTS

| | | | | |
|---|---|---|---|---|
| 6,079,904 | A * | 6/2000 | Trisl | 405/107 |
| 6,098,352 | A * | 8/2000 | Coffen | 52/169.7 |
| 6,119,316 | A * | 9/2000 | Ishihara et al. | 24/297 |
| 6,199,333 | B1 * | 3/2001 | Viduka, Jr. | 52/300 |
| 6,315,495 | B1 * | 11/2001 | Starheim | 405/129.8 |
| 6,345,934 | B1 * | 2/2002 | Jailloux et al. | 405/262 |
| 6,378,144 | B1 * | 4/2002 | Yurchision | 4/506 |
| 6,443,655 | B1 * | 9/2002 | Bennett | 405/114 |
| 6,540,201 | B1 * | 4/2003 | Gagnon et al. | 249/139 |
| 7,014,391 | B2 * | 3/2006 | Starheim et al. | 405/129.8 |
| 7,121,764 | B2 * | 10/2006 | Rorheim | 405/107 |
| 7,322,714 | B2 * | 1/2008 | Barnett et al. | 362/152 |
| 7,523,592 | B2 * | 4/2009 | Horwitz | 52/716.8 |
| 7,690,865 | B1 * | 4/2010 | Stewart et al. | 405/115 |
| 7,997,828 | B2 * | 8/2011 | Rijlaarsdam | 405/114 |
| 8,028,476 | B1 * | 10/2011 | Alford | 52/126.4 |
| 8,074,406 | B2 * | 12/2011 | Ksenych et al. | 52/169.7 |
| 2003/0196395 | A1 * | 10/2003 | Forbis et al. | 52/300 |

* cited by examiner

LIQUID CONTAINMENT SYSTEM

This invention relates to a containment system for containing within a specified area a spilled liquid.

BACKGROUND OF THE INVENTION

Many prior patents and other disclosures show various constructions of a temporary berm or bin system which can be easily transported, erected without tools, and easily dismantled. Typically this comprises a set of panels or planks joined with sliding clips to form a bin having vertical or near vertical sides. The bin can be lined with an impervious sheet to form a containment for use in controlling the dispersal of hazardous material spilled from storage or work facilities. In some cases, spring loaded clamps hold the liner securely to a top edge of the panel or in other cases the liner can be attached to a position adjacent the bottom edge. In all cases it is preferred that the panels are assembled and the liner installed without nailing, sewing, or other labor consuming and/or tear prone methods. The berm is particularly suited to protect oil well drilling sites in environmentally sensitive environments such as arctic tundra.

It is desirable that no excavation or other disturbance of the soil is required to erect the protective berm. The berm can be secured to the ground and supported by triangular support gussets at spaced positions around the outside of the panels. The complete system including the panels, gussets and liner is preferably arranged so that it is easily transported by ordinary truck.

SUMMARY OF THE INVENTION

It is one object of the invention to provide a set of parts to be used in assembling a portable containment system.

According to one aspect of the invention there is provided a set of parts for assembly into a liquid containment barrier comprising:

a plurality of panels, each having a top edge, a bottom edge, an inner surface, an outer surface, a first end and a second end such that the panels can be arranged with the first end of one connected to the second end of a second to form a peripheral wall surrounding an area to be confined;

the top edges of the panels being arranged at a common height to define a common top edge of the peripheral wall;

and a liner arranged to extend across the ground inside the peripheral wall and arranged to be connected to the peripheral wall;

wherein each panel has the top edge as a raw edge standing upwardly from the panel without any additional flange portion;

wherein the panels are horizontally corrugated to form horizontal ribs and valleys;

and a plurality of elongate extruded plastics spring channel members each engaged over the top edge at positions along the top edge and having a part-cylindrical portion engaged over the top edge and a pair of legs extending downwardly from the top edge arranged to engage the inner and outer surfaces respectively.

Optionally there is provided a plurality of additional clamp collars each shorter than the channel members and arranged to surround the part cylindrical portion of the channel members.

When provided, the clamp collars can be used to bridge between an end of one channel member and an end of a next adjacent channel member, for example where the channel members end at an end of the panels and the clamp collars are arranged to bridge between an end of one panel and an end of a next adjacent panel.

When provided, the additional clamp collars can provide additional and localized clamping force on the channel members, for example where the additional clamp collars are located at a respective one of the bracket members to engage a component of the bracket members.

In one example, the liner extends over the channel members and the additional clamp collars are arranged to clamp the liner on to the outer surface of the part cylindrical portion of the channel members.

Preferably the channel members are flexible to bend around a curvature when the peripheral wall is formed as a circle rather than as a rectangle with specific corners.

Preferably the channel members are of a length at least equal to the length of the panels.

In one arrangement, the liner is connected at the bottom of the wall at a position spaced from the channel members so that the channel members provide protection of the raw steel edge for protection of personnel and items draped over the top edges of the panels. In this case, each channel member may have at least one extruded groove on an inside surface of the part cylindrical portion thereof arranged to receive the top edge of the panel.

In some containment confirmations such as those having straight sides greater than a length which is self supporting, there is provided a plurality of support bracket members arranged to stand vertically at spaced positions along the peripheral wall for connection to the panels to hold the panels and the peripheral wall vertical. In this case, each bracket member can include an upstanding brace portion with an inner vertical edge for engaging and supporting the outer surface of one of the panels and, in order to provide an assembly system which reduces the requirement for tools, each bracket member includes a rod member having a lower hook end for engaging onto the brace portion at a position thereon outward of the inner edge and an upper hook end for engaging over the channel members. This acts to hold the panels in place until the assembly of the peripheral wall is complete.

Preferably the upper hook end of the rod is arcuate to partly surround the part cylindrical portion of the channel member at the top edge.

In another assembly system which reduces the requirement for tools, preferably the bracket member includes an upwardly extending flange which defines with the inner vertical edge of the brace portion a channel for receiving the bottom edge of the panel so that the bottom edge of the panel is prevented from moving outwardly by the inner vertical edge of the brace portion and is prevented from moving inwardly by the flange. This flange can be part of a plate member clamped underneath a bottom edge of the brace portion.

In another assembly system which reduces the requirement for tools, preferably each of the panels has at the first end thereof a first connecting plate bolted to the panel and having a height substantially equal to the height of the panel and has at the second end thereof a second connecting plate bolted to the panel and having a height substantially equal to the height of the panel, each of the first and second plates being bent to form a series of coaxial sleeves along an outer edge of the plate so that the sleeves of the first plate engage between the sleeves of the second plate to receive a rod extending coaxially of the sleeves of both plates to hold the plates connected. The plates thus can form hinges which can articulate for circular systems or to form corners or can remain coplanar to connect panel along one side of the system.

According to a second aspect of the invention there is provided a set of parts for assembly into a liquid containment barrier comprising:

a plurality of panels, each having a top edge, a bottom edge, an inner surface, an outer surface, a first end and a second end such that the panels can be arranged with the first end of one connected to the second end of a second to form a peripheral wall surrounding an area to be confined;

the top edges of the panels being arranged at a common height to define a common top edge of the peripheral wall;

and a liner arranged to extend across the ground inside the peripheral wall and arranged to be connected to the peripheral wall;

wherein each panel has the top edge as a raw edge standing upwardly from the panel without any additional flange portion;

a plurality of elongate extruded plastics spring channel members each engaged over the top edge at positions along the top edge and having a part-cylindrical portion engaged over the top edge and a pair of legs extending downwardly from the top edge arranged to engage the inner and outer surfaces respectively.

and a plurality of additional clamp collars each shorter than the channel members and arranged to surround the part cylindrical portion of the channel members.

According to a third aspect of the invention there is provided a set of parts for assembly into a liquid containment barrier comprising:

a plurality of panels, each having a top edge, a bottom edge, an inner surface, an outer surface, a first end and a second end such that the panels can be arranged with the first end of one connected to the second end of a second to form a peripheral wall surrounding an area to be confined;

the top edges of the panels being arranged at a common height to define a common top edge of the peripheral wall;

and a liner arranged to extend across the ground inside the peripheral wall and arranged to be connected to the peripheral wall;

wherein each panel has the top edge as a raw edge standing upwardly from the panel without any additional flange portion;

a plurality of elongate extruded plastics spring channel members each engaged over the top edge at positions along the top edge and having a part-cylindrical portion engaged over the top edge and a pair of legs extending downwardly from the top edge arranged to engage the inner and outer surfaces respectively;

wherein the liner is connected at the bottom of the wall at a position spaced from the channel members so that the channel members provide protection of the raw steel edge for protection of personnel and items draped over the top edges of the panels.

Thus the system provides a protection system for the top edge of the panels which also can provide a liner clamping arrangement that is comprised of:

a) long extruded clamp/edge protector which are long spring channel members or pieces, which are flexible around corners, UV resistant, hot/cold compatible, etc b) Mating short pieces or clamp collars which clamp to the long piece to bridge across joints in the long piece, provide additional and localized clamping force of the long pieces if required and can also clamp liner to the long pieces This arrangement has application in existing primary and secondary containment systems and are also an integral component of an assembly system which reduces the requirement for tools.

Thus for bottom mount secondary containment systems, where the liner is connected at the bottom of the wall rather than at the top, the system provides protection of the raw steel edge for protection of personnel working around or crossing over the system wall sheets or panels and also protects hoses, cords, or other items draped over the edges of the system. In this application the long channel members extend along and over the wall sheet edges and grip to the steel edge. The short clamp collars engage over the long channel members where required to provide additional clamping force and to bridge across joints in the channel members. The clamp collars may or may not be a requirement.

In a top mounted liner systems, where the liner is connected at the top of the wall rather than at the bottom, the parts will work in one of two ways. The liner can be laid over the raw steel edge and secured in place with the channel members which grip both the steel and the liner. The short clamp collars provide additional clamping force at strategic locations and also bridge across joints in the channel members.

The outer bottom edge, at the outside surface of the wall panels, of the channel members can be used as a guide edge to cut the excess liner so it can be removed. This provides a nice finish to the system. As well as clamping the liner, the system also provides protection to personnel as above. Again the short clamp collars may or may not be a requirement.

As an alternative, the channel members can also go over the raw steel edge first and then the liner drapes over it. The short clamp collars then secure the liner to the channel members at strategic locations. In this manner the long channel members act to protect the liner from the raw steel edge and the clamp collars act to secure the liner. Here the clamp collars are required.

As part of an assembly system which reduces the requirement for tools, the parts above can be used as described above as a liner clamp and in addition they work as part of the wall sheet securing method in conjunction with the wire loops.

According to a fourth aspect of the invention there is provided a set of parts for assembly into a liquid containment barrier comprising:

a plurality of panels, each having a top edge, a bottom edge, an inner surface, an outer surface, a first end and a second end such that the panels can be arranged with the first end of one connected to the second end of a second to form a peripheral wall surrounding an area to be confined;

the top edges of the panels being arranged at a common height to define a common top edge of the peripheral wall;

wherein each of the panels has at the first end thereof a first connecting plate bolted to the panel and having a height substantially equal to the height of the panel and has at the second end thereof a second connecting plate bolted to the panel and having a height substantially equal to the height of the panel, each of the first and second plates being bent to form a series of coaxial sleeves along an outer edge of the plate so that the sleeves of the first plate engage between the sleeves of the second plate to receive a rod extending coaxially of the sleeves of both plates to hold the plates connected.

According to a fifth aspect of the invention there is provided a set of parts for assembly into a liquid containment barrier comprising:

a plurality of panels, each having a top edge, a bottom edge, an inner surface, an outer surface, a first end and a second end such that the panels can be arranged with the first end of one connected to the second end of a second to form a peripheral wall surrounding an area to be confined;

the top edges of the panels being arranged at a common height to define a common top edge of the peripheral wall;

and a plurality of support bracket members arranged to stand vertically at spaced positions around the peripheral wall for connection to the panels to hold the panels and the peripheral wall vertical;

wherein each bracket member includes an upstanding brace portion with an inner vertical edge for engaging and supporting the outer surface of one of the panels;

and wherein each bracket member includes a rod member having a lower hook end for engaging onto the brace portion at a position thereon outward of the inner edge and an upper hook end for engaging over the top edge of the panel.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
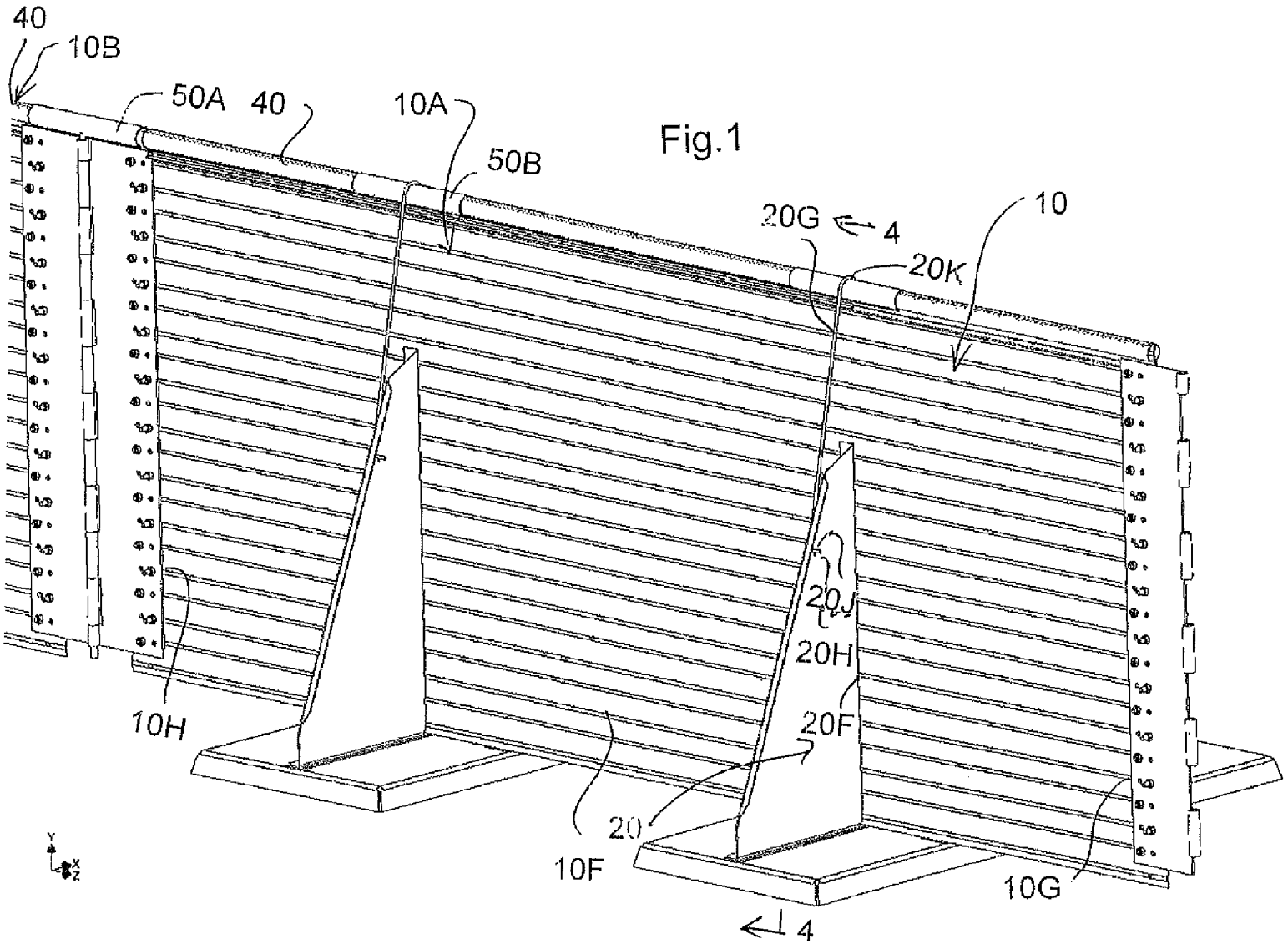
FIG. 1 is an isometric view of a containment barrier according to the present invention showing the outside of the peripheral wall and providing an assembly system which reduces the requirement for tools.
Figure 2:
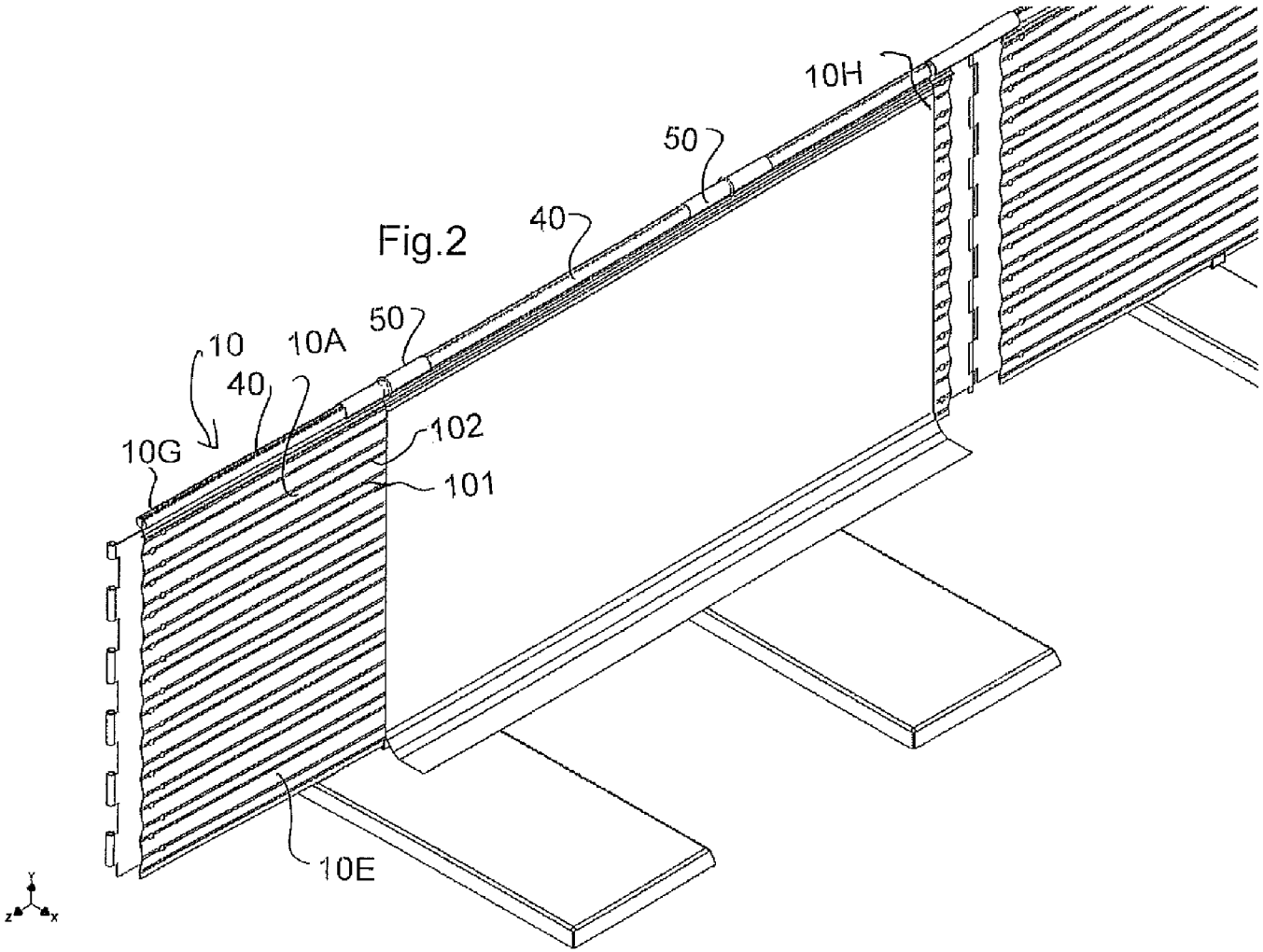
FIG. 2 is an isometric view of the containment barrier of FIG. 1 showing the inside of the peripheral wall with the liner attached to the top of the wall.

The arrangement shown in the drawings comprises a set of parts for assembly into a liquid containment barrier which in the figures are shown in the assembled position.

Figure 4:
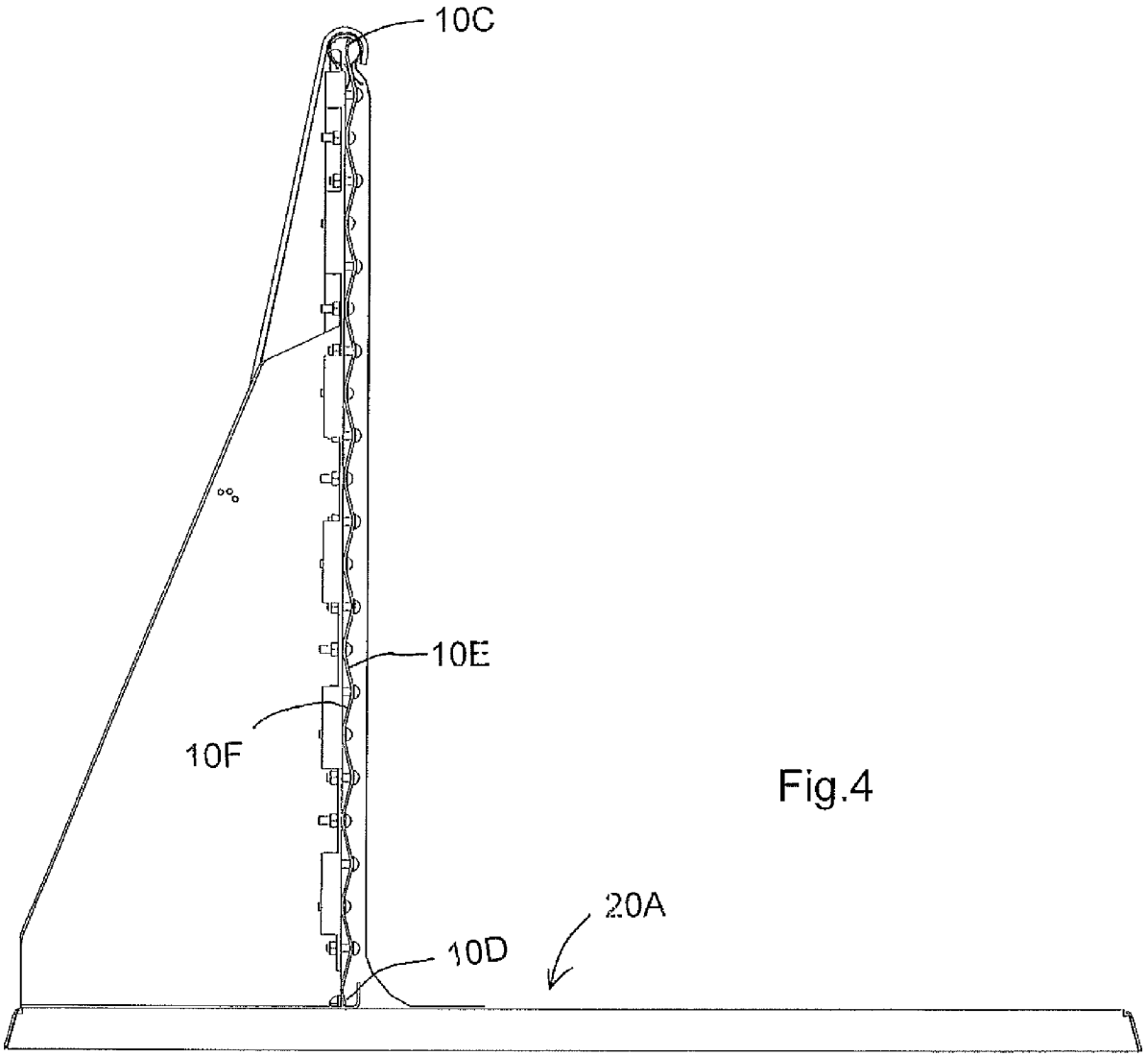
FIG. 4 is a cross-sectional view of the containment barrier of FIG. 1 along the lines 4-4 of FIG. 1.
Figure 5:
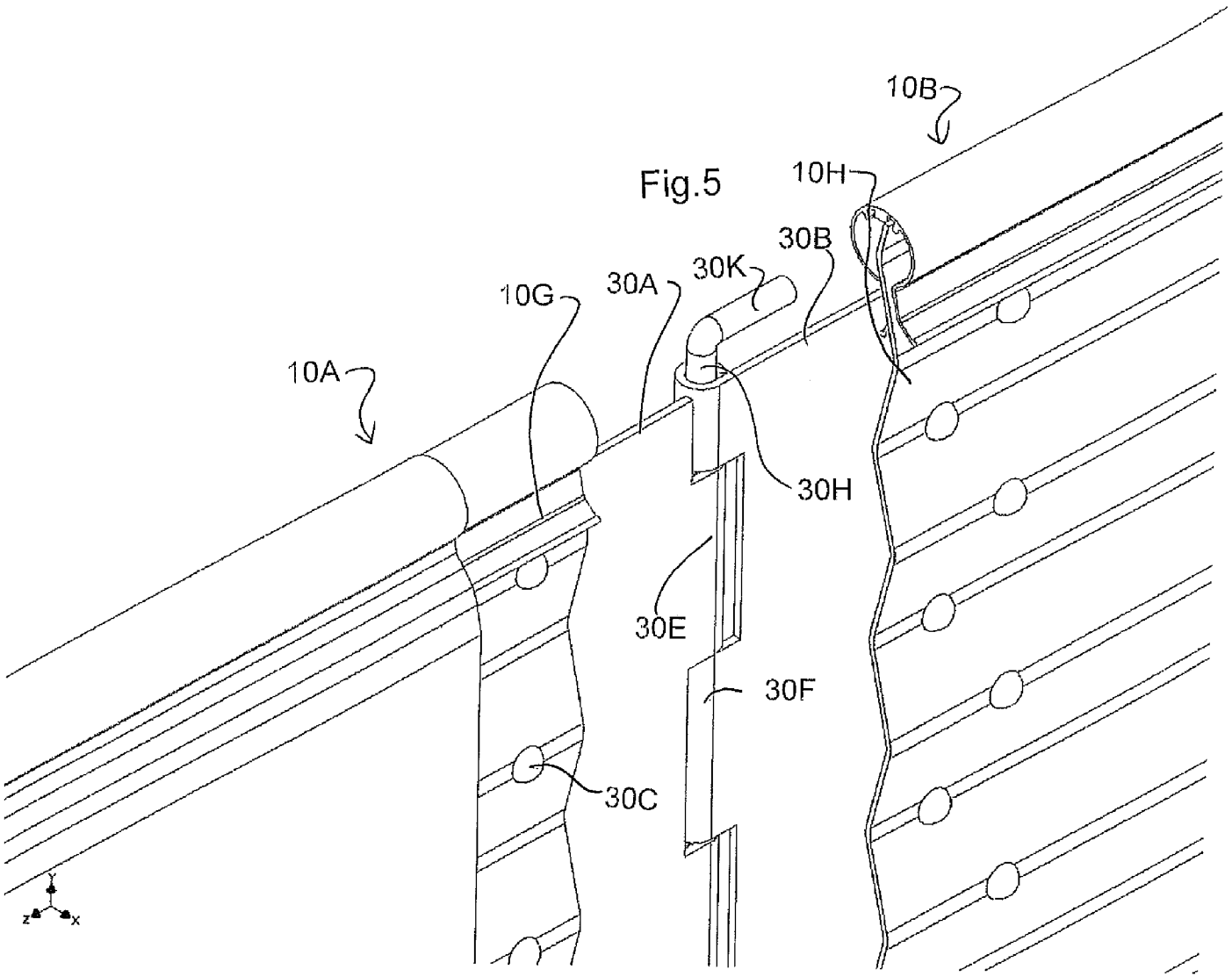
FIG. 5 is an isometric view of the containment barrier of FIG. 1 showing connection between two panels.

A peripheral wall 10 is formed by a plurality of panels 10A, 10B etc, each having a top edge 10C (best shown in FIGS. 4 and 6), a bottom edge 10D, an inner surface 10E and an outer surface 10F.

Each panel has a first end 10G and a second end 10H such that the panels can be arranged with the first end of one connected to the second end of a second to form the complete peripheral wall surrounding an area to be confined.

The panels are formed from the same material used in grain bins so as to be horizontally corrugated for strength to form horizontal ribs 101 and valleys 102. The panels are of the same height so that the top edges 10C of the panels are arranged at a common height to define a common top edge of the peripheral wall with the bottom edge 10D resting on the ground.

Figure 3:
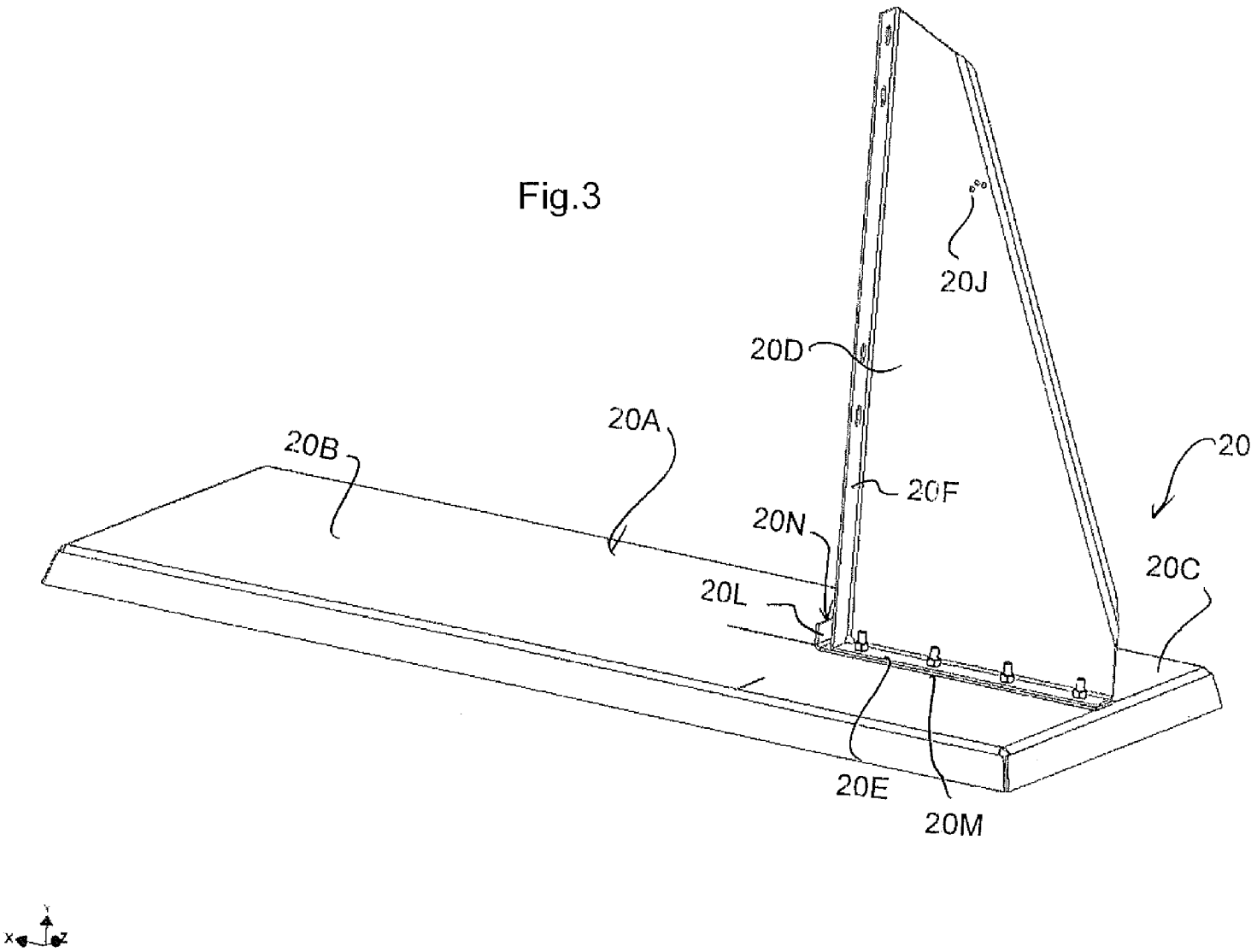
FIG. 3 is an isometric view of the containment barrier of FIG. 1 showing one bracket member including a base plate and a brace member.

The system further includes a plurality of support bracket members 20 (FIG. 3) arranged to stand vertically at spaced positions around the peripheral wall for connection to the panels 10A to hold the panels and the peripheral wall 10. vertical.

Each bracket member 20 includes a base plate 20A bridging the wall with an inner piece 20B inside the wall and an outer piece 20C outside the wall so that the wall sits on the base plates at the brackets and sits on the ground between the brackets. On the base plate at the outer piece 20C is mounted a generally triangular upstanding brace portion 20D formed of a plate with a bottom flange 20E bolted to the base plate. An inner vertical flange 20F defines an inner edge for engaging and supporting the outer surface of one of the panels 10A.

Each bracket member 20 further includes a rod member 20G having a lower hook end 20H for engaging through a selected one of a plurality of holes 20J in the plate forming the brace portion at a position thereon outward of the inner edge 20F. At the upper end, the rod member 20G includes an upper hook end 20K for engaging over the top edge of the wall.

Preferably each bracket member includes an upstanding brace portion with an inner vertical edge 20F for engaging and supporting the outer surface 10F of one of the panels and, in order to provide an assembly system which reduces the requirement for tools, each bracket member 20 includes a rod member 20G having a lower hook end 20H for engaging onto the brace portion at a position thereon outward of the inner edge and an upper hook end 20K for engaging over the channel members. This acts to hold the panels in a vertical orientation particularly in respect of long sides which have a tendency to be unstable unless restrained.

The bracket member 20 includes an upwardly extending flange 20L which defines with the inner vertical edge 20F of the brace portion a channel 20N for receiving the bottom edge 10D of the panel so that the bottom edge of the panel is prevented from moving outwardly by the inner vertical edge of the brace portion and is prevented from moving inwardly by the flange. This flange 20L is part of an L-shaped plate 20M member clamped underneath the bottom flange 20E of the brace portion 20D.

Each of the panels 10A, 10B has at the first end 10G thereof a first connecting plate 30A bolted to the panel 10A and has at the second end thereof a second connecting plate 30B bolted to the panel 10B. Each of the first and second plates has a height substantially equal to the height of the panel and is connected to the panel by bolts 30C passing through the ribs 101 and by bolts 30D passing through the valleys 102. Each plate is bent to form a series of coaxial sleeves 30E, 30F along an outer edge of the plate so that the sleeves 30E of the first plate 30A engage between the sleeves 30F of the second plate 30B to receive a rod 30H extending coaxially of the sleeves of both plates to hold the plates connected. Thus the rod 30H with an upper handle portion 30K can be dropped through the sleeves with the ends of the panels aligned to simply and quickly connect the panels with the panels being either in a common vertical plane or arranged at an angle to one another at the axis defined by the rod 30H. Thus the panels can be arranged at equal small angular differences to proscribe a circle or some can be in a common plane with others at right angles to form a rectangular containment.

As part of the assembly, a liner is provided in most cases and is arranged to extend across the ground inside the peripheral wall to be connected to the peripheral wall. The liner can extend over the top edge to ensure leak protection on the wall.

Figure 8:
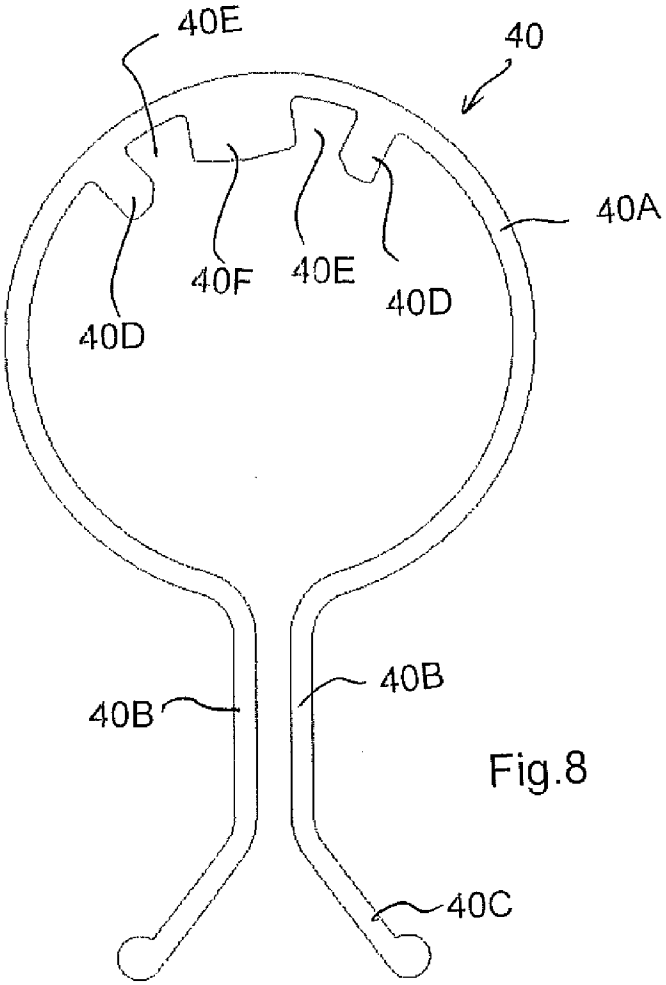
FIG. 8 is a cross-sectional view of one channel member of the containment barrier of FIG. 1.

There is provided a plurality of elongate spring channel members 40 each engaged over the top edge at positions along the top edge. Each channel member 40 is extruded from a plastics material and is of the cross-section shown in FIG. 8. This provides a part-cylindrical portion 40A engaged over the top edge and closing around the panel sides to contact the inner and outer surfaces of the panel. The channel 40 includes and a pair of legs 40B extending downwardly from the part cylindrical portion 40A arranged to engage the inner and outer surfaces respectively. At the bottom end of the leg is provided a flared edge portion 40C allowing the user to grasp an end of the leg to manipulate the channel member to a required position and to facilitate ease of application, particularly when applying over the liner. The extruded channel members are supplied typically cut to a length at least equal or generally exactly equal to the length of the panels. The channel members are extruded from a material which is sufficiently deformable to be flexible to bend around corners when the peripheral wall is formed as a rectangle rather than as a circle.

Each channel member has a smooth outer surface but includes two extruded grooves 40E on the inside surface of the part cylindrical portion 40A thereof defined between a center rib 40F and two outer spaced ribs 40D. The grooves are arranged to receive the top edge of the panel and there are two either side of the center rib 40F for symmetry in order to allow insertion of the edge inwardly or outwardly bearing in mind that the top panel edge is canted in one direction by the corrugations. The grooves thus assist in locating the channel member. The legs are located to provide a slight inward spring pressure on the wall. The legs also prevent the channel member from rolling about its axis if a lateral force is applied such as a hose dragged across it.

There is therefore provided a plurality of additional C-shaped clamp collars 50, again of an extruded plastics material, each shorter than the channel members and arranged to surround and grip the part cylindrical portion 40A of the channel members 40.

As shown in FIG. 1 at 50A, the clamp collars are used to bridge between an end of one channel member 40 on panel 10A and an end of a next adjacent channel member on panel 10B. Thus the channel members 40 end at an end of the panels 10A and 10B and the clamp collars 50 are arranged to bridge between an end of one panel 10A and an end of the next adjacent panel 10B.

The additional clamp collars also provide additional and localized clamping force on the channel members. Thus as shown in FIG. 1 at 50B, the additional clamp collars are located at a respective one of the bracket members 20 to engage the hook 20K of the rod member 20G. The upper hook end 20K of the rod is arcuate at the same radius of curvature as the collar to partly surround the part cylindrical portion of the channel member and the collar 50B at the top edge.

Figure 6:
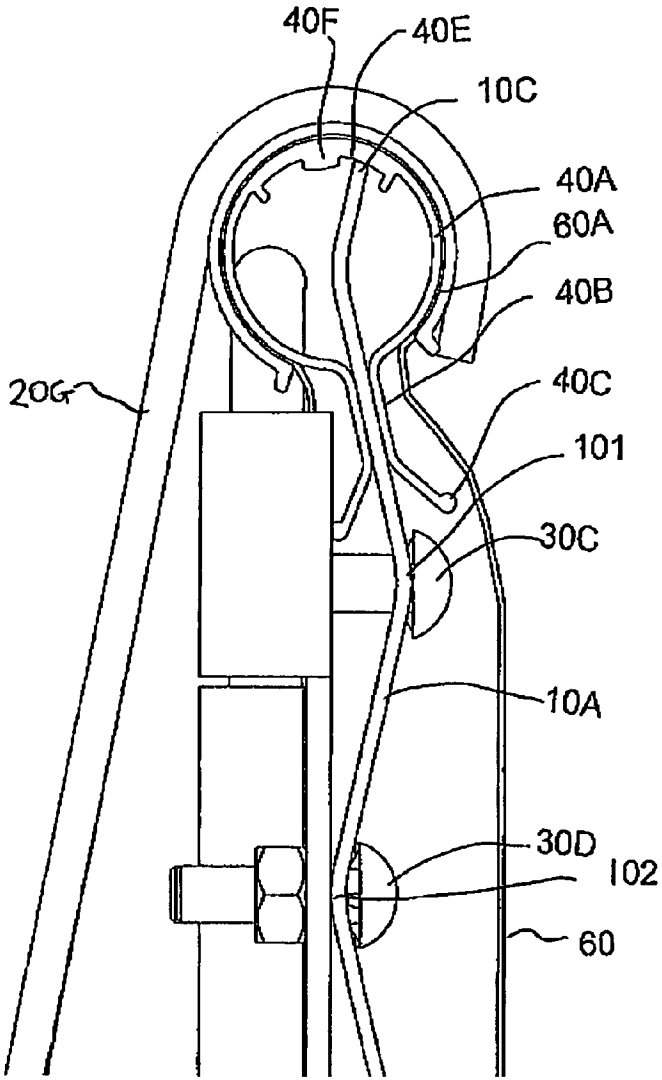
FIG. 6 is a cross-sectional view of the containment barrier of FIG. 1 along the lines 4-4 of FIG. 1 on an enlarged scale.
Figure 7:
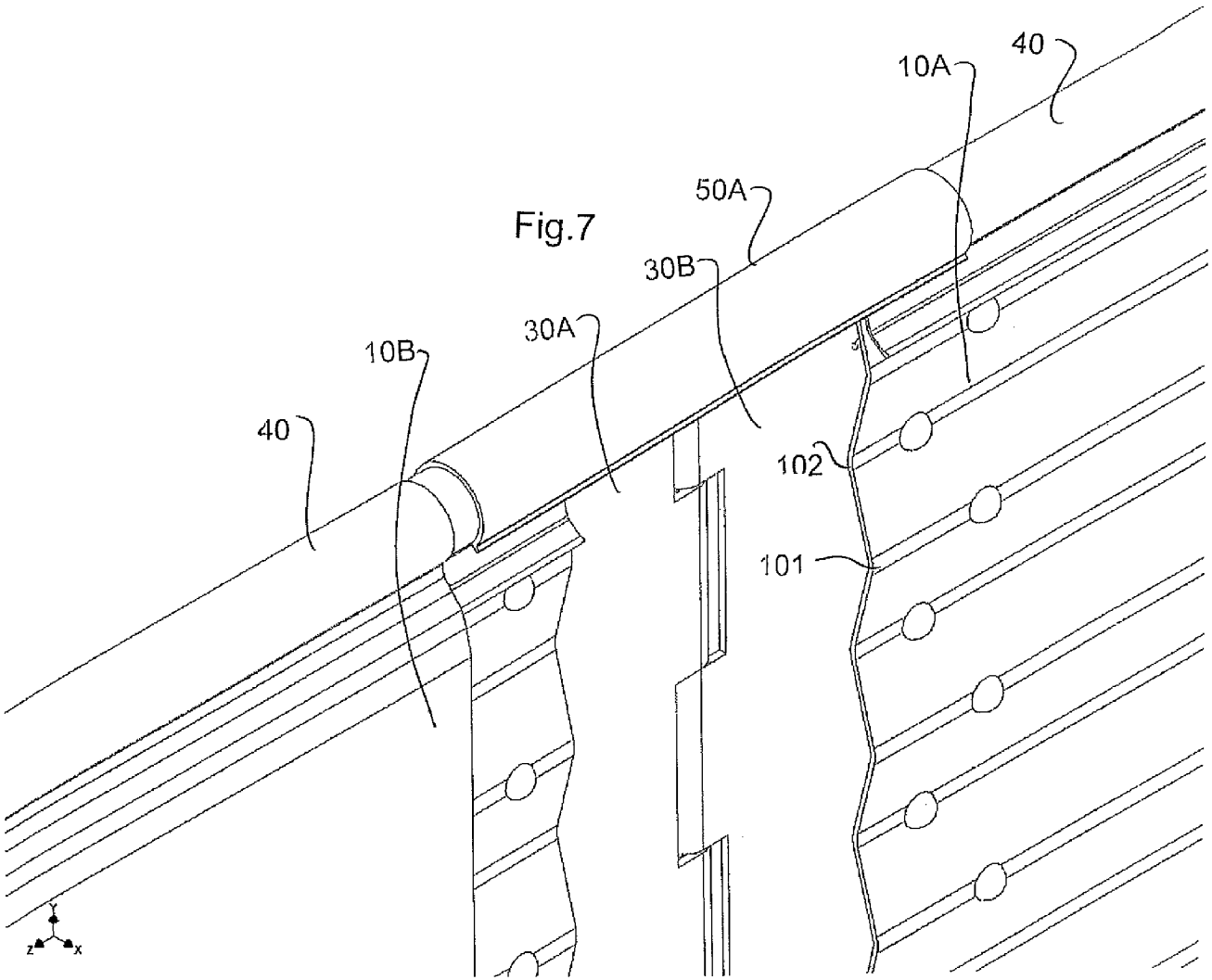
FIG. 7 is an isometric view of the containment barrier of FIG. 1 showing connection between two panels and including the additional clamping member and showing the bottom mount system of FIG. 9.

As shown in FIG. 6, the liner 60 extends over the part cylindrical portion 40A of the channel members 40 and the additional clamp collars 50 clamp the edge portion 60A of the liner 60 on to the outer surface of the part cylindrical portion 40A of the channel members.

Figure 10:
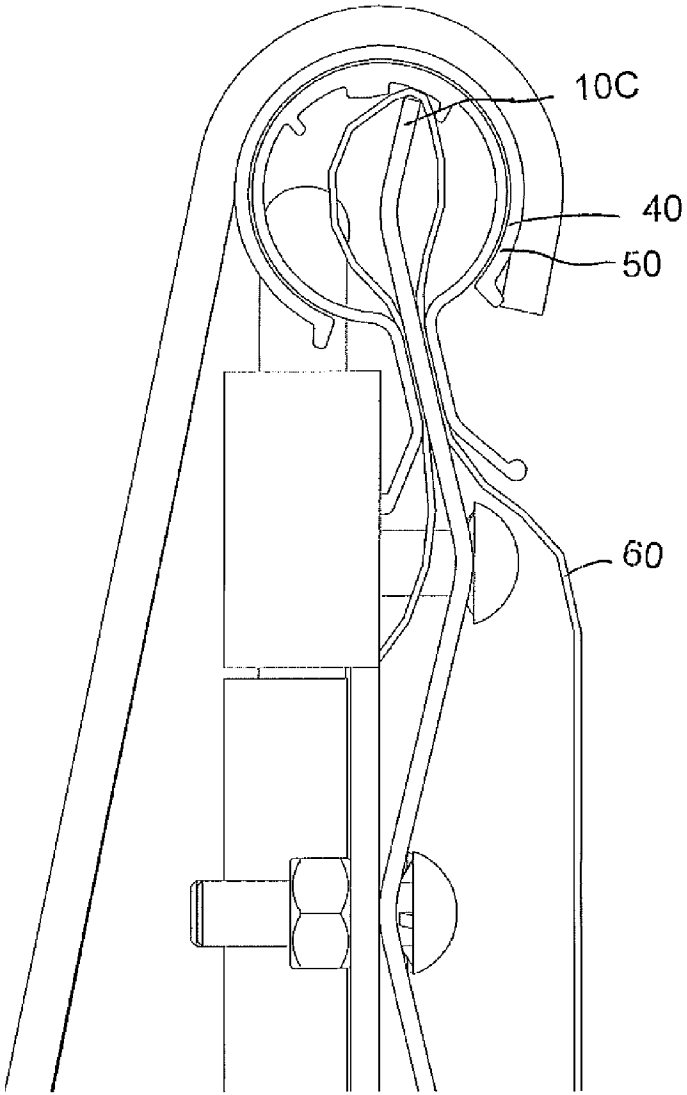
FIG. 10 is a cross-sectional view similar to that of FIG. 6 but showing the liner underneath the channel members.

Alternatively, as shown in FIG. 10 the liner drapes over the panel top edge and is held in place by the channel member 40 which is pulled down from the top. If required additional clamping force can be strategically applied with the clamp collars 50.

Figure 9:
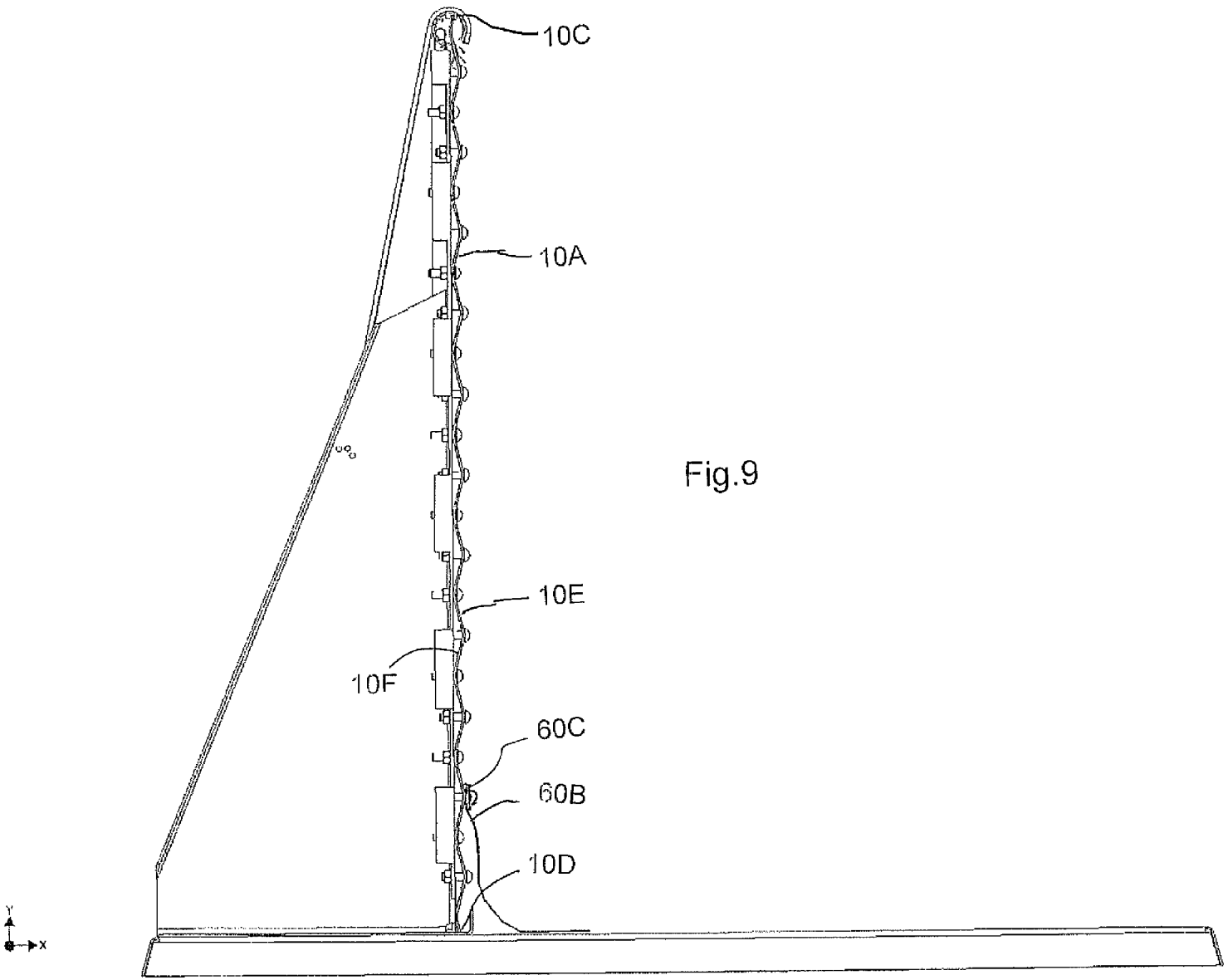
FIG. 9 is a cross-sectional view similar to that of FIG. 4 but showing a bottom mount arrangement where the liner is attached to the wall at a position adjacent the bottom.

As shown in FIG. 9, the edge 60B of the liner 60 is clamped at a bolted clamp bar 60C at the bottom of the wall at a position spaced from the channel members 40 so that the channel members 40 act to provide protection of the raw steel edge for protection of personnel and items draped over the top edges of the panels. Thus for bottom mount secondary containment systems, where the liner is connected at the bottom of the wall rather than at the top, the system provides protection of the raw steel edge for protection of personnel working around or crossing over the system wall sheets or panels and also protects hoses, cords, or other items draped over the edges of the system. Although the arrangement shown in FIG. 9 includes the plate type coupling system between panels, typically this is not used in bottom liner mounting arrangements since such a plate type coupling will leak. Thus conventional bolted connections are provide between panels with suitable gaskets as are well known to persons skilled in this art.

Each panel is formed of a sheet with the corrugations 101, 102 extending to a top edge of the sheet leaving the top edge as a raw edge standing upwardly from the panel without any additional flange portion. This avoids the necessity for an additional machining process to form the typical horizontal flange which when used provides structural strength and protection against presentation of a sharp edge. Thus in the present arrangement the raw edge is presented upwardly as a potentially dangerous sharp edge and is protected by the channel members 40.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A liquid containment barrier comprising:

a plurality of panels, each having a top edge, a bottom edge, an inner surface, an outer surface, a first end and a second end such that the panels can be arranged with the first end of one panel connected to the second end of a second panel to form a peripheral wall surrounding an area to be confined;

the top edges of the panels being arranged at a common height to define a common top edge of the peripheral wall;

wherein each panel has the common top edge as a raw edge of a single upstanding metal sheet standing upwardly from the panel without any additional flange portion where the common top edge defines the inner surface and the outer surface spaced by a thickness of the panel;

a plurality of support bracket members arranged to stand vertically at spaced positions around the peripheral wall outside the peripheral wall for connection to the panels to hold the panels and the peripheral wall vertical;

and a plurality of elongate extruded plastics spring channel members each engaged over the common top edge at positions along the common top edge;

each of the extruded spring channel members comprising a cylindrical portion having a hollow interior engaged over the common top edge with the common top edge entering into the hollow interior of the cylindrical portion;

the cylindrical portion of each channel member having at least three longitudinal parallel ribs extending inwardly from an inside surface thereof defining the hollow interior;

the parallel ribs including a central rib aligned with the pair of legs and a first rib on one side of the central rib and a second rib symmetrically with the first rib on an opposed side of the central rib;

said first and second longitudinal ribs being spaced apart relative to the central rib so as to define therebetween first and second parallel grooves on the inside surface of the cylindrical portion thereof so that the common top edge is received and located in the first groove where the common top edge is inclined inwardly and in the second groove where the common top edge is inclined outwardly;

wherein each bracket member includes an upstanding brace portion with an inner vertical edge engaging and supporting the outer surface of one of the panels;

and wherein each bracket member includes a rod member;

the rod member having a lower hook end defined by a first bent portion of the rod member engaging onto the brace portion at a position thereon outward of the inner edge;

and the rod member having an upper arcuate hook defined by a second bent portion of the rod member end engaging over the cylindrical portion of the extruded spring channel member at the common top edge of the panel;

the extruded spring channel member being held captured by the upper arcuate hook so that lifting movement of the extruded spring channel member causes upward pulling forces on the rod member to resist the lifting;

the upper arcuate hook being free from connection to components inside the peripheral wall so that all upward puling forces are communicated to the rod member.

2. The liquid containment barrier according to claim 1 including a plurality of additional cylindrical clamp collars each shorter than the channel members and having an inside surface of each of the cylindrical clamp collars closely surrounding the cylindrical portion of the channel members.

3. The liquid containment barrier according to claim 2 wherein the cylindrical clamp collars bridge between an end of one channel member and an end of a next adjacent channel member.

4. The liquid containment barrier according to claim 2 wherein the channel members are arranged to end at an end of the panels and the clamp collars are arranged to bridge between an end of one panel and an end of a next adjacent panel.

5. The liquid containment barrier according to claim 2 wherein the additional clamp collars are arranged to provide additional and localized clamping force on the channel members.

6. The liquid containment barrier according to claim 2 wherein the additional clamp collars are arranged to be located at a respective one of the bracket members to engage a component of the bracket members.

7. The liquid containment barrier according to claim 2 wherein a liner extends over the cylindrical channel members and the additional clamp collars clamp the liner on to the outer surface of the cylindrical portion of the channel members.

8. A liquid containment barrier comprising:

a plurality of panels, each having a top edge, a bottom edge, an inner surface, an outer surface, a first end and a second end such that the panels can be arranged with the first end of one panel connected to the second end of a second panel to form a peripheral wall surrounding an area to be confined;

the top edges of the panels being arranged at a common height to define a common top edge of the peripheral wall;

and a liner arranged to extend across the ground inside the peripheral wall and arranged to be connected to the peripheral wall;

wherein each panel has the common top edge as a raw edge of a single upstanding metal sheet standing upwardly from the panel without any additional flange portion where the common top edge defines the inner surface and the outer surface spaced by a thickness of the panel;

wherein the panels are horizontally corrugated to form horizontal ribs and valleys and so that the common top edge is inclined inwardly or outwardly depending on the position of the top common edge relative to the ribs and valleys;

and a plurality of elongate extruded plastics spring channel members each engaged over the common top edge at positions along the common top edge;

each of the extruded spring channel members comprising a cylindrical portion having a hollow interior and a pair of legs extending downwardly from the cylindrical portion to an end thereof remote from the cylindrical portion;

the cylindrical portion being engaged over the common top edge with the common top edge entering into the hollow interior of the cylindrical portion;

the pair of legs extending downwardly from the cylindrical portion at the common top edge;

the pair of legs having inside surfaces thereof in engagement with the inner and outer surfaces respectively of the common top edge;

the cylindrical portion of each channel member having at least three longitudinal parallel ribs extending inwardly from an inside surface thereof defining the hollow interior;

the parallel ribs including a central rib aligned with the pair of legs and a first rib on one side of the central rib and a second rib symmetrically with the first rib on an opposed side of the central rib;

said first and second longitudinal ribs being spaced apart relative to the central rib so as to define therebetween first and second parallel grooves on the inside surface of the cylindrical portion thereof so that the common top edge is received and located in the first groove where the common top edge is inclined inwardly and in the second groove where the common top edge is inclined outwardly.

9. The liquid containment barrier according to claim 8 there is provided a plurality of support bracket members standing vertically at spaced positions along the peripheral wall to hold the panels and the peripheral wall vertical and wherein each bracket member includes an upstanding brace portion with an inner vertical edge engaging and supporting the outer surface of one of the panels and wherein each bracket member includes a rod member having a lower hook end engaging onto the brace portion at a position thereon outward of the inner edge and an upper arcuate hook end engaging over the cylindrical portion of a respective one of the channel members.

10. The liquid containment barrier according to claim 9 wherein the bracket member terminates at a height below the top edge and the rod member extends upwardly and inwardly from the lower end over the top edge.

11. The liquid containment barrier according to claim 9 wherein the lower hook end extends through a hole in the brace portion.

12. The liquid containment barrier according to claim 8 including a plurality of additional cylindrical clamp collars each shorter than the channel members and having an inside surface of each of the cylindrical clamp collars closely surrounding the cylindrical portion of the channel members.

13. The liquid containment barrier according to claim 12 wherein the cylindrical clamp collars bridge between an end of one channel member and an end of a next adjacent channel member.

14. The liquid containment barrier according to claim 12 wherein the channel members are arranged to end at an end of the panels and the clamp collars are arranged to bridge between an end of one panel and an end of a next adjacent panel.

15. The liquid containment barrier according to claim 12 wherein the additional clamp collars are arranged to provide additional and localized clamping force on the channel members.

16. The liquid containment barrier according to claim 12 wherein there is provided a plurality of support bracket members arranged to stand vertically at spaced positions along the peripheral wall for connection to the panels to hold the panels and the peripheral wall vertical and wherein the additional clamp collars are arranged to be located at a respective one of the bracket members to engage a component of the bracket members.

17. The liquid containment barrier according to claim 12 wherein the liner extends over the cylindrical channel members and the additional clamp collars clamp the liner on to the outer surface of the cylindrical portion of the channel members.

* * * * *